US008007408B1

(12) United States Patent
Moran et al.

(10) Patent No.: US 8,007,408 B1
(45) Date of Patent: Aug. 30, 2011

(54) TREADMILL SPEED CONTROL SYSTEM

(75) Inventors: Thomas H Moran, Madison, WI (US); Nathan Pyles, Lake Mills, WI (US)

(73) Assignee: Johnson Health Tech Co., Ltd. (TW)

( * ) Notice: Subject to any disclaimer, the term of this patent is extended or adjusted under 35 U.S.C. 154(b) by 0 days.

(21) Appl. No.: 12/573,634

(22) Filed: Oct. 5, 2009

(51) Int. Cl.
*A63B 22/02* (2006.01)
*A63B 71/00* (2006.01)
*A63B 21/005* (2006.01)

(52) U.S. Cl. ..... 482/54; 482/2; 482/5

(58) Field of Classification Search ..... 482/1–9, 482/37, 51, 54, 61, 900; 119/70; 434/247, 434/255, 258; 601/23, 32, 35; *A63B 22/02, A63B 71/00*

See application file for complete search history.

(56) References Cited

U.S. PATENT DOCUMENTS

| | | | | |
|---|---|---|---|---|
| 5,314,391 | A * | 5/1994 | Potash et al. | 482/7 |
| 5,618,245 | A * | 4/1997 | Trulaske et al. | 482/7 |
| 5,800,314 | A * | 9/1998 | Sakakibara et al. | 482/54 |
| 5,803,870 | A * | 9/1998 | Buhler | 482/8 |
| 5,879,270 | A * | 3/1999 | Huish et al. | 482/8 |
| 6,475,121 | B2 * | 11/2002 | Wang et al. | 482/54 |
| 6,945,912 | B2 * | 9/2005 | Levi | 482/54 |
| 7,572,208 | B2 * | 8/2009 | Brewer | 482/37 |
| 2008/0132386 | A1 * | 6/2008 | Helie et al. | 482/54 |

* cited by examiner

*Primary Examiner* — Loan Thanh
*Assistant Examiner* — Oren Ginsberg
(74) *Attorney, Agent, or Firm* — Robert Burck

(57) ABSTRACT

A treadmill apparatus having a non-motorized tread, a sensor for sensing a parameter indicative of the tread speed, and a controller operatively connected to an angle adjustment mechanism to increase and decrease the angle of the tread. During operation of the treadmill, the controller compares the speed of the tread to a target speed, and based on the comparison, adjust the angle of the tread so that the operator's weight will adjust the speed of the tread.

25 Claims, 8 Drawing Sheets

TREADMILL SPEED CONTROL SYSTEM

FIELD AND BACKGROUND OF THE INVENTION

The present invention relates to a treadmill with a non-motorized tread, as well as methods to set and control the speed of the tread.

Exercise treadmills are widely used for walking or running aerobic-type exercise while the operator remains in a relatively stationary position. Exercise treadmills typically have a tread, which is an endless running surface extending between and movable around two substantially parallel and spaced apart rollers. The tread may be made of a belt of a rubber-like material, or alternatively, the tread may be made of a number of slats positioned substantially parallel to one another and attached to one or more bands which extend around the rollers.

Early treadmills had non-motorized treads that required the operator to provide all of the force necessary to drive and control the speed of the tread by walking or running on the tread surface. Such treadmills were difficult to operate and control. To help control tread speed, some non-motorized treadmills included a flywheel engaged with belt rollers to limit the speed of the belt. Yet even with a flywheel, these treadmills were difficult to use, and the speed of the treadmill was difficult to control.

Some non-motorized treadmills were designed to be propped up at one end, such that the tread was inclined at an angle. The inclined non-motorized tread was easier to start because the weight of the operator caused the tread to slide down the slope of the incline. This addition of an inclined tread eliminated some of the effort required by the operator to get the tread surface moving, but it was still difficult to maintain a desired speed especially if the tread angle was set too low. Conversely, if the tread angle was set too high, the tread might move faster than desired. Braking mechanisms or speed governors were then added to limit the speed of the treadmill.

Motorized treadmills were developed to solve some of the limitations of the earlier non-motorized treadmills. In a typical motorized treadmill, the belt tread is driven by a motor rotating the front roller, which then rotates the tread. The speed of the motor was adjustable to simulate running or walking, as desired. Some current treadmills also have the ability to adjust the tread incline, and some have power driven inclination systems to vary the exercise effort or aerobic effect, with small changes in tread inclination. These motorized treadmills offer independent control of the tread speed and the incline angle of the tread.

The addition of the motors to treadmills has some disadvantages. For example, motorized treadmills require the treadmill to be located near an appropriate electrical source, which limits the potential locations where the treadmill can be placed. The power requirements of some treadmill drive motors are large, and require specialized power sources, such as dedicated circuits, 20 Amp circuits, 240 Volt electrical outlets, or three-phase electrical outlets. The cost of operating and maintaining motorized treadmills is also higher than non-motorized treadmills.

In addition, motorized treadmills typically cost more than non-motorized treadmills because drive motors and motor controllers are relatively expensive and can account for a significant portion of the total cost of the treadmill. Another disadvantage of motorized treadmills is that the physical size and weight of a drive motor increases the overall size and weight of the treadmill, and may require specialized designs for moving and storage.

Thus, there is needed a treadmill that limits power usage while also enabling an operator to reach and maintain desired tread speeds with relative ease.

SUMMARY OF THE INVENTION

A treadmill of the present invention includes a non-motorized tread, a tread speed sensor, and a controller in communication with an angle adjustment mechanism to increase and decrease the angle of the tread and thereby increase or decrease the speed of the tread. During operation of the treadmill, the controller compares the speed of the tread to a target speed, and based on the comparison, increases or decreases the angle of the tread so that the operator's weight contributes more or less, respectively, to the speed of the tread.

A flywheel, a battery, or some other type of energy storage device may be charged by energy generated by the non-motorized tread. For example, a battery charged by the tread's rotation can be used to store and supply electrical energy, and can be electrically connected to a variety of electrical components used with the treadmill, such as the controller, for example.

In accordance with the invention, a battery can be used to supply power to the controller, speed sensor, angle adjustment mechanism, or other powered devices connected to the treadmill. Other devices can supply electrical energy to components other than the tread, such as solar-electric panels, fuel cells, capacitors, and generators. Other devices or combinations of these devices can be used while remaining within the scope of the invention.

Also a flywheel rotated by the tread can be used in the present invention to store and supply rotational or kinetic energy of the tread. The flywheel can be operatively connected to the tread to help maintain tread speed and to govern acceleration or deceleration of the tread. Other energy storage devices could also be used to the same effect in accordance with the invention.

A treadmill with a flywheel in accordance with the present invention, can have the flywheel attached to a roller around which the tread is disposed. As the tread moves, the roller turns, causing the flywheel to spin. Inertia from the spinning flywheel helps maintain a consistent speed of the tread.

Alternatively, a flywheel can be located elsewhere, such as in front of the tread, and operatively connected to the tread by a set of pulleys and a belt. One advantage of this configuration is that the set of pulleys may be sized to rotate the flywheel at a faster rate than the roller around which the tread is disposed. By increasing the angular velocity of the flywheel, the size and weight of the flywheel can be reduced, while still maintaining the same rotational inertia. Other flywheel locations could be used to the same effect while remaining within the scope of the invention.

The treadmill may also have a braking mechanism and/or a generator, either of which could be used to slow down the speed of the tread, or add resistance to motion of the tread to increase exercise intensity. Examples of braking mechanisms include eddy current brakes, viscous damping brakes, frictional brakes, fluid resistance or air resistance. Other types of braking mechanisms can be used to the same effect while remaining within the scope of the invention.

If a generator is operatively connected to the tread, electrical energy can be generated by the moving tread, allowing a battery to be charged during the exercise. This electrical power can be used to power the angle adjustment mechanism, controller, tread speed sensor, or many other electrical devices associated with the treadmill. This electrical power can also be stored in a battery for use at a later time.

Additionally, the generator can be used as a braking mechanism for the tread. The generator has a portion that is stationary, and a portion that is rotatable. The generator is connected to the tread in such a way that motion of the tread rotates the rotatable portion of the generator, thereby generating electricity. Conversely, as electricity is generated by the generator, a braking force is created within the generator, and this braking force is transmitted back to the tread. The amount of braking force can be controlled by placing a resistive load across the output terminals of the generator. The braking force can be varied by applying a varying resistive load across the output terminals of the generator, or by employing pulse width modulation. Other devices and methods for altering the braking force applied to the tread by a generator, can be used within the scope of the invention.

The present invention is directed to a non-motorized treadmill that avoids the previously described disadvantages of motorized treadmills, such as cost and weight of the drive motor, as well as the cost of operation, while having the ability to match the speed of the tread to a target tread speed.

DETAILED DESCRIPTION OF THE INVENTION

Figure 1:
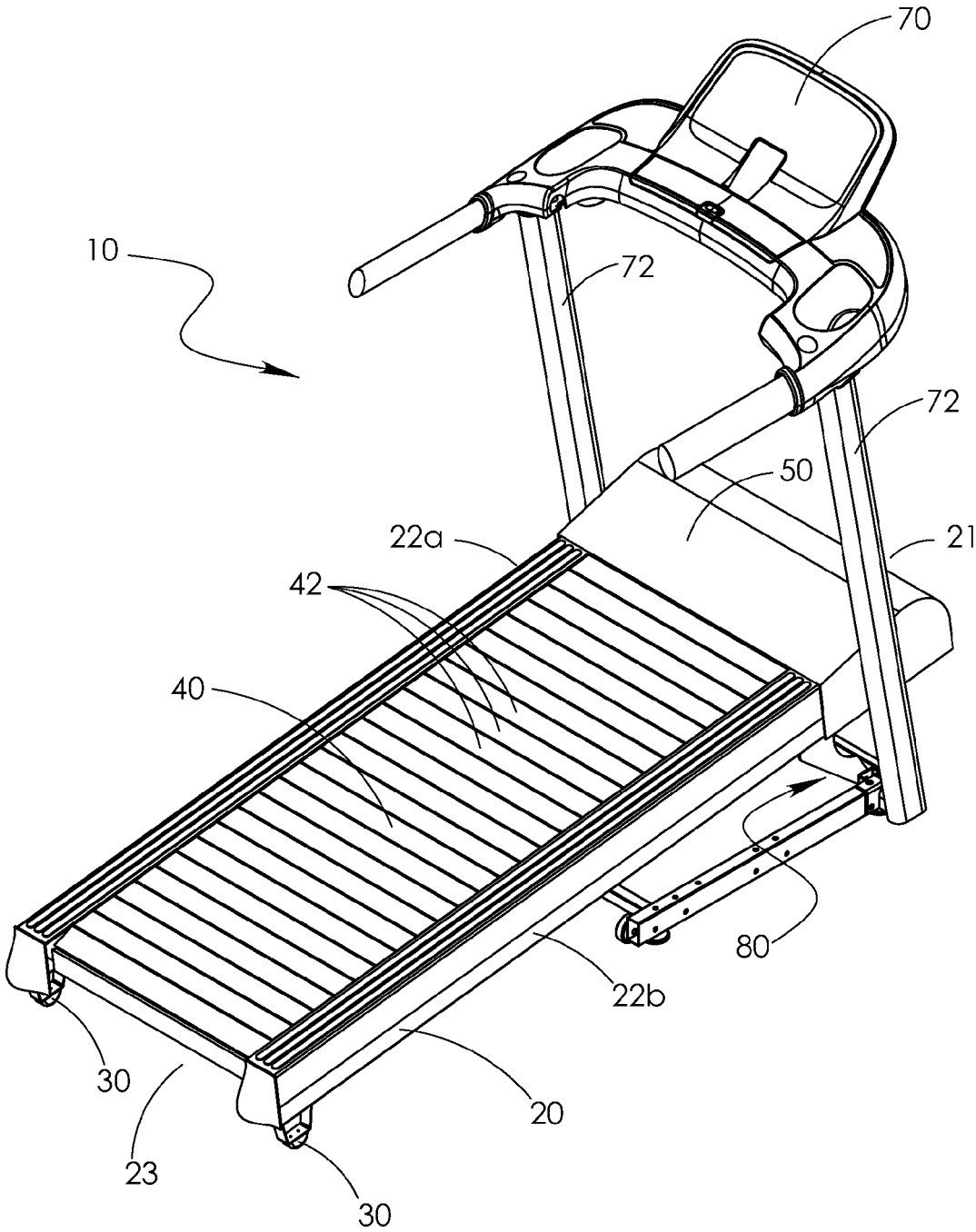
FIG. 1 is a rear perspective view of a treadmill apparatus according to a first embodiment of the present invention.

FIG. 1 shows a treadmill 10 of the present invention including a frame 20, a tread 40, and an angle adjustment mechanism 80. The frame 20 includes a front end 21, a pair of side frame members 22*a*, 22*b*, and a rear end 23. The treadmill 10 also includes a pair of feet 30, a compartment cover 50, a console 70, and a pair of masts 72 for supporting the console 70.

The frame 20 supports the tread, 40, and the two side frame members 22*a*, 22*b* are arranged parallel to one another and are joined by at least one cross member (not shown) to maintain the two side frame members 22*a*, 22*b* in position with respect to one another. The frame 20 in the illustrated embodiment includes upright masts 72 supporting the console 70, but the masts 72, when used, are not required to be attached to the frame 20. The frame 20 preferably includes the feet 30 for leveling and/or for supporting the treadmill 10 on the ground, floor or other support surface 35.

The tread 40 is operatively mounted on the frame 20 such that the tread 40 is free to revolve in the longitudinal direction relative to the frame 20. The tread 40 is rotatably mounted on two or more rollers such as a front roller 42 and a rear roller 44 shown in FIGS. 4, 5*a*, 5*b*, 6*a*, 6*b* and 8. The tread 40 is in the form of an endless loop, with the upper portion of the tread 40 forming a running surface that is located between the front roller 42 and the rear roller 44. The tread 40 includes a number of slats 42 arranged transversely to the frame 20 and transversely to the direction of tread movement. The slats 42 are preferably positioned substantially parallel to one another, with each slat 42 supported at or near its two ends by the side frame members 22*a*, 22*b* or some other portion of the frame 20. Though the frame 20 supports the slats 42, the slats are configured to be movable along the frame 20. The slats 42 are substantially stiff and are able to support a load of an operator on the tread 40 without any other supporting structure. Other tread designs such as an endless belt can be used, though an endless belt may require an underlying deck or some other supporting surface to support the load of an operator. The tread 40 is a "non-motorized tread," and no motor is used to drive the tread 40. Only a motive force applied by the operator when walking or running, or some other externally applied force, can start the tread 40 moving.

The angle adjustment mechanism 80 adjusts the incline angle of the tread 40. As shown in FIG. 1, the angle adjustment mechanism 80 raises and lowers the front end 21 of the tread 40, changing the tread's 40 incline angle relative to the ground. The treadmill 10 is designed to be placed on a support surface 35, and in this embodiment the support surface 35 is illustrated to be substantially horizontal, and the surface of the tread 40 can be inclined by the angle adjustment mechanism 80 so that the tread 40 is at an angle relative to horizontal. Other support surface 35 angles are also possible, so in the present invention, the incline mechanism 80 adjusts the tread 40 angle relative to any angle of the support surface 35. The incline angle can be measured in percent grade, for example, so the incline position might have an incline angle with a negative number if the elevation of the front end of the tread 40 is lower than the back end of the tread 40, it can be zero if the front end of the tread 40 is the same elevation as the back end of the tread 40, or it might be a positive number if the elevation of the front end of the tread 40 is higher than the back end of the tread 40.

Figure 2:
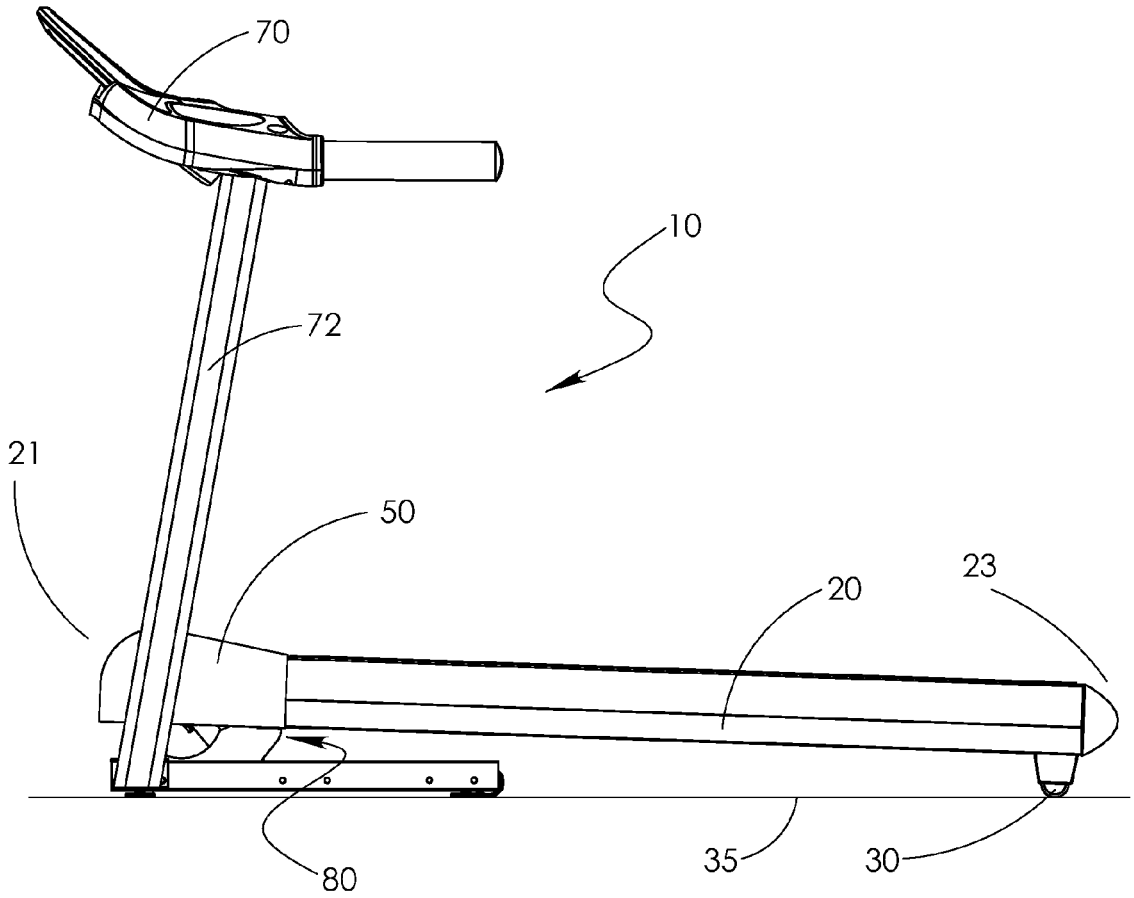
FIG. 2 is a side view of the treadmill of FIG. 1, with the tread orientation at a low angle of incline.

FIG. 2 shows a side view of the tread 40 in a relatively low incline position, with the rear end of the frame 20 supported on a support surface 35 by the feet 30 and the front end 21 is supported by the angle adjustment mechanism 80. In this embodiment, the angle adjustment mechanism 80 adjusts the angle of the frame 20 to adjust the tread angle, and in other embodiments, the angle adjustment mechanism 80 can act on the tread independently of the frame 20.

Figure 3:
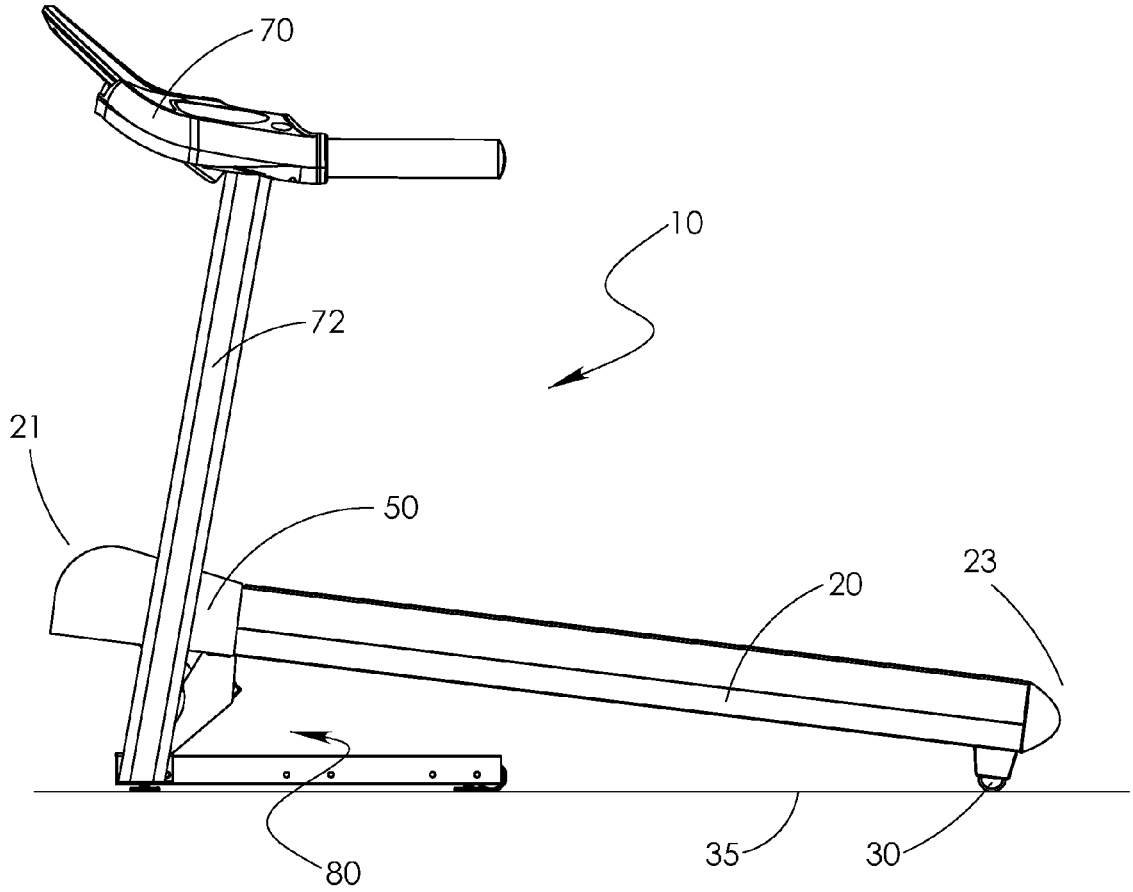
FIG. 3 is a side view of the treadmill of FIG. 1, with the tread orientation at a high angle of incline.

FIG. 3 shows the same side view as FIG. 2, but with the tread 40 in a relatively steep incline position, with the rear end 23 of the frame 20 supported on the support surface 35 by the feet 30 and the front end 21 supported by the angle adjustment mechanism 80.

Figure 4:
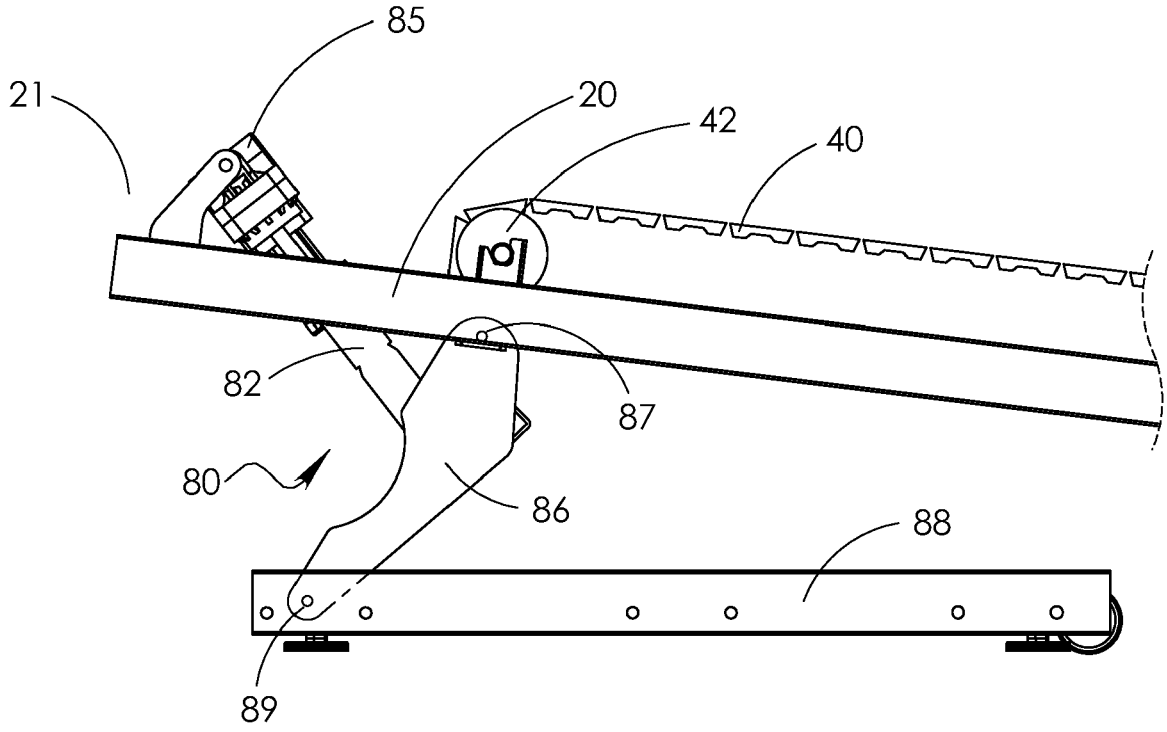
FIG. 4 is a detail view of the exercise apparatus of FIG. 1, showing the angle adjustment mechanism.

FIG. 4 shows a detailed view of the angle adjustment mechanism 80. The angle adjustment mechanism 80 preferably includes a lift motor 85 connected to the frame 20, an extending member 82, a link 86 pivotally connected to the frame 20 at a first pivot 87, and a contact member 88 in contact with the support surface 35 at a second pivot 89. As the lift motor 85 drives the end of the extending member 82 away from the lift motor 85, the link 86 is rotated about the pivot 89 causing the pivot 87 and the front end of the frame 20 to be lifted upward. This upward motion at the front end of the frame 20 changes the angle of the frame 20 and the tread 40, but in some embodiments the frame 20 remains stationary and only the tread 40 moves. Other types of angle adjustment mechanisms can be used with the invention.

Figure 5A:
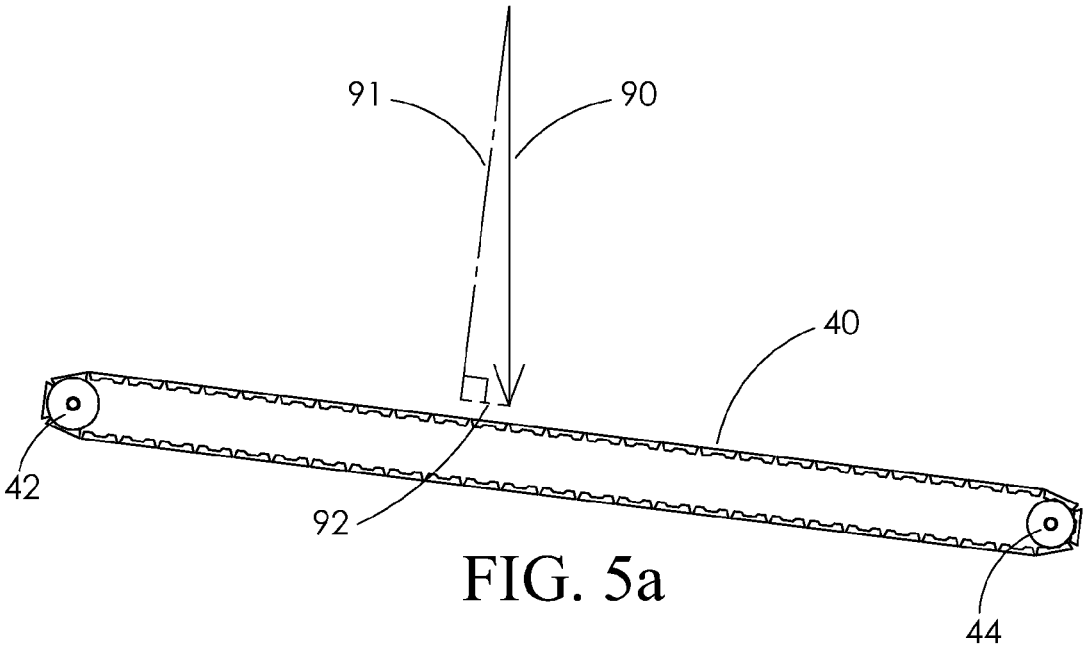
FIG. 5*a* is a schematic view of the tread of the exercise apparatus of FIG. 1 with the tread shown at a small incline angle.
Figure 5B:
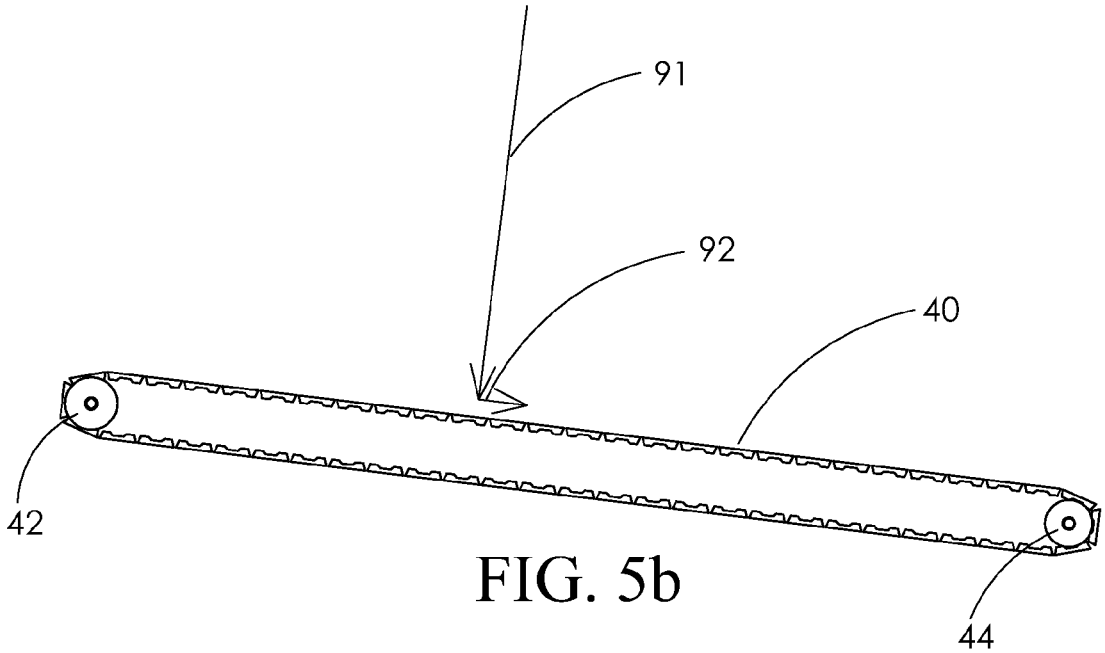
FIG. 5*b* is an alternate schematic view of FIG. 5*a*.

To illustrate how an operator's weight revolves the tread 40, FIG. 5*a* schematically shows a downward force 90 applied to the tread 40. This downward force 90 could also be from any other external load applied to the tread 40. This downward force 90 can be broken up into two forces, a normal force 91 which is normal (perpendicular) to the surface of the tread 40, and a longitudinal force 92 which is parallel to the surface of the tread 40. The tread 40 is shown at a relatively low angle of incline in FIGS. 5*a* and 5*b*. The magnitude of the longitudinal force 92 is equal to the magnitude of the downward force 90 multiplied by the sine of the angle of incline, and the magnitude of the longitudinal force will be very small when the angle of incline of the tread 40 is very small. When the longitudinal force transferred by friction from the operator's feet to the tread 40 is very small, the tread 40 may not move at all due to friction between the tread 40, the rollers 42, 44, and the frame 20, or the tread 40 may rotate about the frame 20 at a low speed due to the small longitudinal force.

Figure 6A:
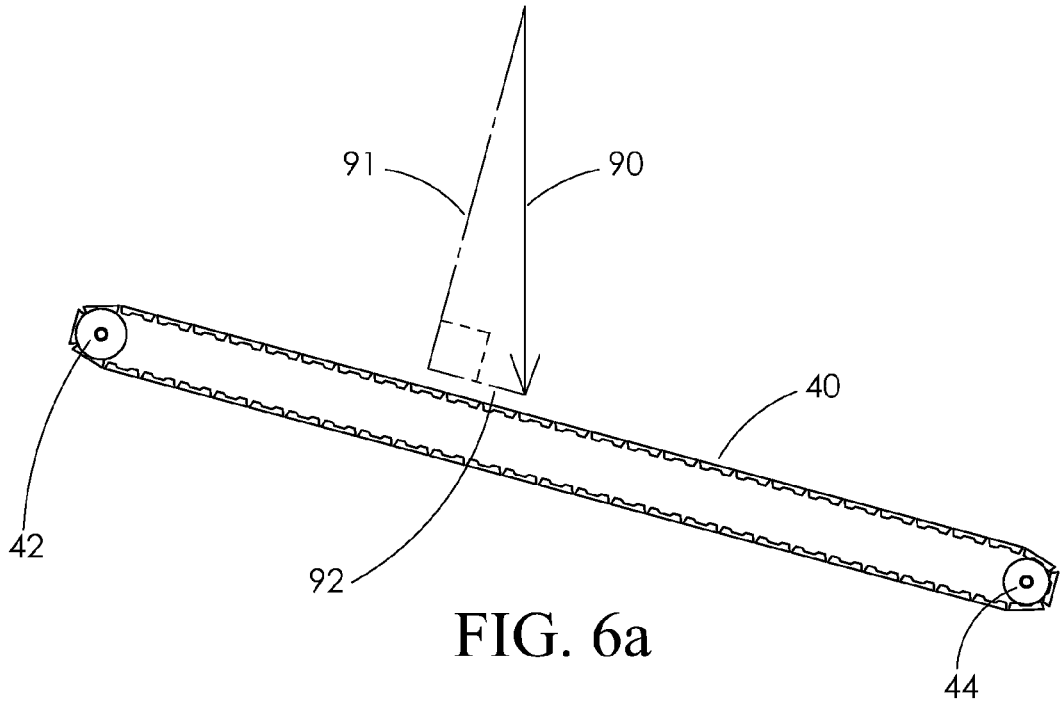
FIG. 6*a* is a schematic view of the tread of the exercise apparatus of FIG. 1.
Figure 6B:
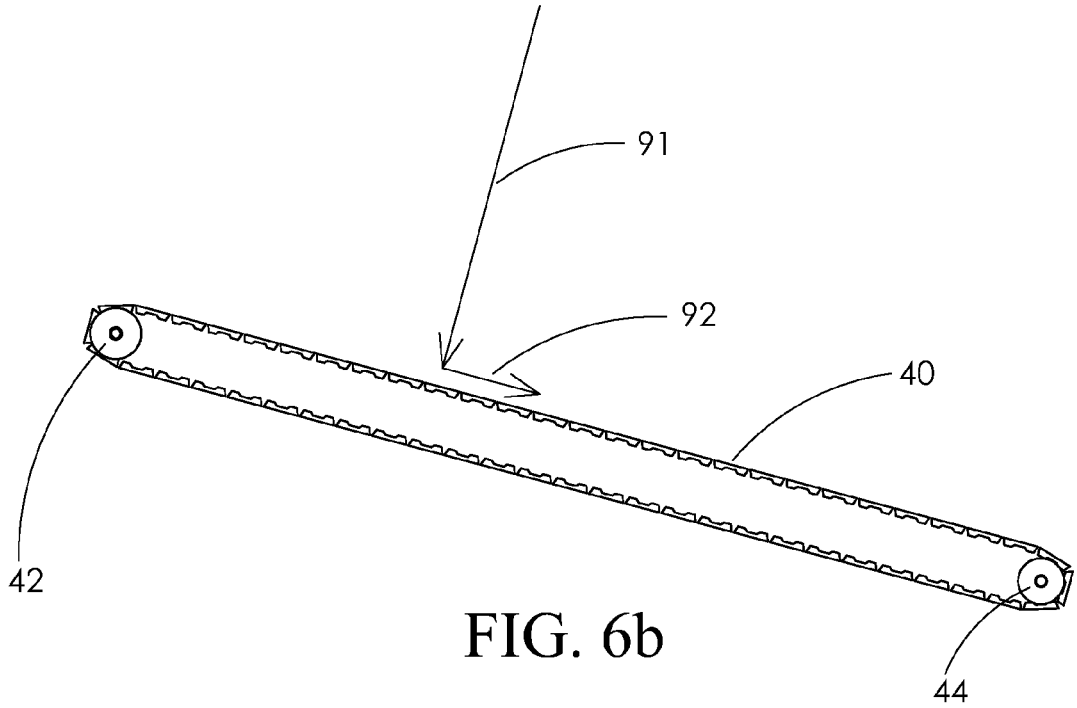
FIG. 6*b* is an alternate schematic view of FIG. 6*a*.

A non-motorized tread rate of rotation or "speed" can be increased by increasing the longitudinal force acting upon the tread 40. To do so in accordance with the present invention, the tread incline angle is increased. FIGS. 6*a*-6*b* show the same magnitude of downward force 90 applied to the tread 40 as was described above in relation to FIGS. 5*a*-5*b*. The magnitude of the longitudinal force 92 is equal to the magnitude of the downward force 90 multiplied by the sine of the angle of incline, and the magnitude of the longitudinal force will be relatively large when the angle of incline of the tread 40 is large. The larger longitudinal force rotates the tread 40 about the rollers 42, 44 at a higher rate of rotation "speed".

FIGS. 5*a*-6*b* show how the treadmill 10 of the present invention can adjust the speed of the tread 40 by altering the incline angle of the tread 40 using the angle adjustment mechanism 80. In operation, an operator on the treadmill 10 can increase the speed of the tread 40 by increasing the incline of the tread 40 to increase the magnitude of the longitudinal force 92. Similarly, an exercise training program can be used to direct the controller 75 to compare the current speed of the tread 40 with a target speed, and based on the results of the comparison, the exercise program can direct the controller 75 to increase the speed of the tread 40 by increasing the incline of the tread 40 to increase the magnitude of the longitudinal force 92. Conversely, the speed of the tread 40 can be reduced by decreasing the incline angle thereby reducing the longitudinal force 92, and the speed of the tread 40.

Figure 7:
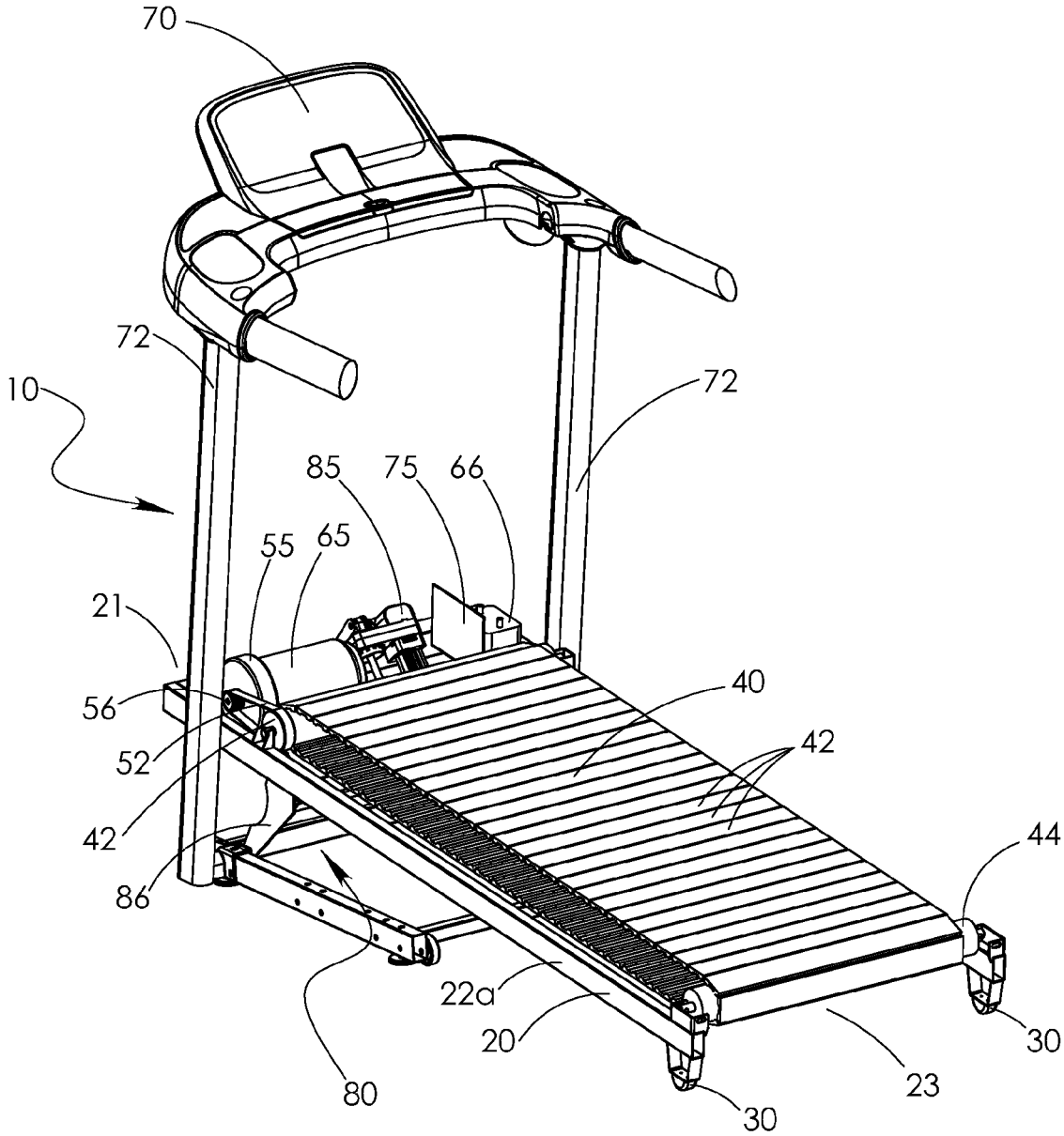
FIG. 7 is a rear perspective view of the treadmill of FIG. 1, with various components removed for clarity.
Figure 8:
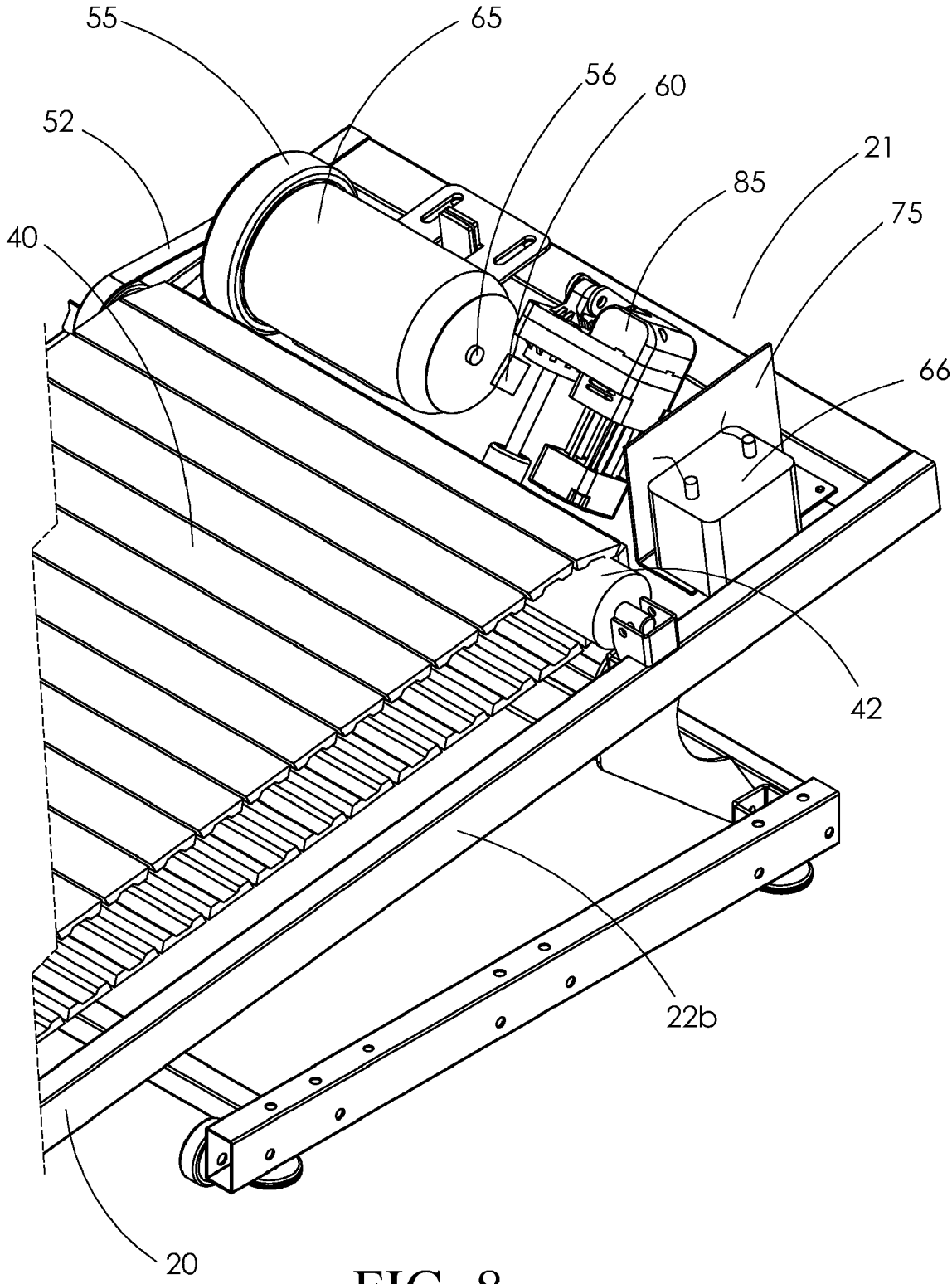
FIG. 8 is a detail view of the treadmill of FIG. 1, with various components removed for clarity.

FIGS. 7 and 8 illustrates the treadmill 10 with the compartment cover 50 removed, to show a belt 52, a flywheel 55, a sensor 60, a generator 65, a battery 66, a controller 75, and a lift motor 85. The flywheel 55 and tread 40 are operatively engaged to one another by the belt 52, so that as the tread 40 moves in the longitudinal direction, a front roller 42, illustrated in FIG. 8, is turned, driving the belt 52, which in turn rotates the flywheel 55. The flywheel 55 acts as an energy storage device, storing a portion of the kinetic energy of the tread 40 in the spinning flywheel as inertia. The flywheel 55 can also supply some of this stored energy back to the tread 40. By sharing kinetic energy between the tread 40 and the flywheel 55, a more uniform speed of the tread 40 can be maintained. The flywheel 55 is not required to be connected to the tread 40 in this specific manner. For example, the flywheel 55 could be mounted directly onto the front roller 42, so that the flywheel 55 would be an integral part of the front roller 42. A specific configuration is described here, but other configurations can be used to perform the same function while remaining within the scope of the invention.

A generator 65 is also shown operatively mounted on the same shaft 56 as the flywheel 55, and is driven by the rotation of the front roller 42. A treadmill 10 of the present invention could have a flywheel 55 with no generator 65, a generator 65 with no flywheel 55, both a flywheel 55 and a generator 65, or neither. Additionally, it should be noted that a flywheel 55 or generator 65 may be mounted in other locations, and in engagement with the tread 40 by an appropriate mechanical or electrical system, including pulleys and belts, or the flywheel 55, and generator 65 can have different geometries than that shown in FIGS. 7 and 8.

The generator 65 is electrically connected to the battery 66, so that the battery 66 can receive and store energy from the generator 65. This energy can then be used to power other components of the treadmill 10 as desired. The controller 75 is connected to many of the electrical components within the treadmill 10, so a convenient way to distribute power to the other components of the treadmill 10 is to electrically connect the generator 65, and the battery 66 to the controller 75. The controller 75 can then direct incoming electrical energy to be stored in the battery 66, and/or selectively direct electricity to other electrical components.

In addition to generating electricity, the generator 65 can also act as a braking mechanism. Instead of driving the tread 40, as a drive motor would do, the generator 65 can tap energy and slow down the tread 40. To use a generator for this purpose, a resistive load can be applied across the output terminals of the generator 65, either at a constant rate or variably to variably resist the revolving motion of the tread 40. Other braking mechanisms can be used in place of the generator 65 as well.

For example, an eddy-current braking mechanism can be used in place of the generator 65 to add resistance to the motion of the tread 40. Braking mechanisms such as viscous dampers, fans (dissipating energy into the air), frictional braking mechanisms and others can be used in the invention.

FIG. 8 also shows a sensor 60 which senses a "speed parameter" that is indicative of the speed of the tread 40. The sensor 60 may directly sense a speed parameter such as the actual speed of the tread 40, or the motion of a related component, an optical or audible target associated with the tread 40, or some other aspect of tread movement so that the speed parameter can be used to calculate a speed or a factor of speed of the tread 40. For instance, the sensor 60 shown in FIG. 8 senses the number of turns of a shaft 56 attached to a flywheel 55. The sensor 60 generates and transmits a signal indicative of the number of times the shaft 56 has rotated, and the sensor 60 or some other component, such as the controller 75, can be programmed to correlate the number of rotations of the shaft 56 over a period of time to the motion of the tread 40 and calculate the speed of the tread 40, for example. The sensor 60 in FIG. 8 is shown measuring the rotational speed of the shaft 56 on which the flywheel 55 and the generator 65 are attached, but the sensor 60 is not dependent upon the presence of either component, and could be placed in other locations to sense some speed parameter that is indicative of the speed of the tread 40, including a device, optical source, or audible source attached to the tread 40, or some other related component. Also, the actual speed of the tread 40 does not need to be calculated to make the comparison described below.

The controller 75 preferably includes a pre-programmed or operator input target speed. For example, the target speed can be input by an operator operating the console 70 or a target speed could be entered at the factory as part of a factory predetermined training program. The controller 75 calculates the speed or related speed parameter such as rotational rate of the tread 40, shaft 56, front roller 42, or rear roller 44. This parameter calculation is based upon a signal from the sensor 60. Then the controller 75 compares the parameter such as the speed of the tread 40 to the target parameter or speed. If the parameter such as tread speed is determined to be less than the target speed by more than a predetermined amount, the controller 75 causes the angle adjustment mechanism 80 to increase the incline angle of the tread 40. In other words, if the speed parameter is outside of and below a predetermined target speed parameter range, the controller 75 causes the angle adjustment mechanism 80 to increase the incline angle of the tread 40 until the speed parameter is within the predetermined target speed parameter range. This increase in tread angle will tend to increase the speed of the tread 40 without the use of a motor. If the speed parameter such as tread speed is determined to be greater than the target speed parameter by more than a predetermined amount, the controller 75 causes the angle adjustment mechanism 80 to decrease the tread incline angle and thereby the speed of the tread 40. In other words, if the speed parameter is outside of and above a predetermined target speed parameter range, the controller 75 causes the angle adjustment mechanism 80 to decrease the incline angle of the tread 40 until the speed parameter is within the predetermined target speed parameter range. Additionally, if the speed parameter such as tread speed is determined to be greater than the target speed parameter by a predetermined amount, the controller 75 can activate a braking mechanism to slow the speed of the tread 40 either alone or in combination with a tread angle change.

A method of adjusting the speed of a non-motorized tread 40 of a treadmill 10, having a frame 20, a tread 40, an angle adjustment mechanism 80, a speed sensor 60 for detecting the tread speed, and a controller 75, is to operate the tread 40 at a tread speed, sense the movement of the tread with the speed sensor 60, transmit a signal to the controller 75, calculate the tread speed with the controller 75 based at least in part on the signal from the speed sensor 60 and compare the tread speed to a target speed parameter, and then have the controller 75 control the angle adjustment mechanism 80 to adjust the incline angle of the tread 40 until the tread speed is within a predetermined target speed parameter range. In addition, the controller 75 can also control other devices such as braking mechanisms to modify the speed of the tread 40.

The method of adjusting the speed of a non-motorized tread 40 does not require that the speed sensor 60 sense or transmit a signal reflective of the actual speed of the tread 40. For instance, the speed sensor 60 may sense a speed parameter that is indicative of the speed of the tread 40, such as the number of revolutions of a shaft 56 or a front roller 42. In this example, the actual speed of the tread 40 may never be calculated, but the speed parameter may still be used by the controller 75 to determine whether the controller 75 should adjust the incline angle of the tread 40, and if so, how the controller 75 should adjust the incline angle of the tread 40. Also, the method does not require that the target speed parameter be entered by an operator or by the manufacturer of the exercise apparatus. The target speed parameter could be preprogrammed into the controller 75 at a manufacturing site, or the target speed parameter could be entered into the controller 75 by an operator, or it could be entered into the controller 75 in some other way.

While the present invention has been described in terms of certain preferred embodiments, additions, deletions, substitutions, modifications and improvements can be made while remaining within the scope and spirit of the invention as defined by the following claims.

The invention claimed is:

1. A treadmill comprising:

a frame;

a non-motorized tread mounted on the frame for movement between a plurality of incline angles;

an angle adjustment mechanism operatively engaged with the non-motorized tread to move the non-motorized tread between the plurality of incline angles;

a sensor in communication with the non-motorized tread, wherein the sensor senses a speed parameter of the non-motorized tread and generates a corresponding signal; and a controller in communication with the sensor and the angle adjustment mechanism, wherein the controller receives the signal from the sensor and operates the angle adjustment mechanism until the speed parameter is within a predetermined target speed parameter range.

2. The treadmill of claim 1, wherein the controller compares the speed parameter to a second target speed parameter and operates the angle adjustment mechanism to adjust the incline angle of the non-motorized tread until the speed parameter is within a second predetermined target speed parameter range.

3. The treadmill of claim 1, wherein the controller comprises an automatic adjustment control program to operate the angle adjustment mechanism to adjust the incline angle of the non-motorized tread.

4. The treadmill of claim 1, wherein the controller operates the angle adjustment mechanism to increase the incline angle relative to horizontal to increase the speed parameter of the non-motorized tread.

5. The treadmill of claim 1, wherein the controller operates the angle adjustment mechanism to decrease the incline angle relative to horizontal to decrease the speed parameter of the non-motorized tread.

6. The treadmill of claim 1, and further comprising a flywheel operatively joined to the non-motorized tread.

7. The treadmill of claim 1, and further comprising a generator operatively joined to the non-motorized tread.

8. The treadmill of claim 1, and further comprising an energy storage device, wherein the energy storage device stores energy generated by the non-motorized tread.

9. The treadmill of claim 1, and further comprising an energy storage device operatively joined to the non-motorized tread and in electrical communication with the controller and the angle adjustment mechanism, wherein the energy storage device stores energy generated by the non-motorized tread, and wherein the energy is used to power the controller and the angle adjustment mechanism.

10. The treadmill of claim 1, and further comprising a braking mechanism operatively joined to the non-motorized tread, wherein the controller operates the braking mechanism to decrease the speed parameter of the non-motorized tread.

11. The treadmill of claim 1, and further comprising a braking mechanism operatively joined to the non-motorized tread, wherein the controller operates the braking mechanism to decrease the speed parameter of the non-motorized tread and the controller operates the angle adjustment mechanism to decrease the incline angle relative to horizontal to decrease the speed parameter of the non-motorized tread.

12. The treadmill of claim 1, and further comprising a generator operatively joined to the non-motorized tread, the generator having a rotatable portion, wherein motion of the non-motorized tread rotates the rotatable portion of the generator, and wherein the rotatable portion of the generator has a resistance to rotation that applies a braking force to the non-motorized tread.

13. The treadmill of claim 1, and further comprising a generator operatively joined to the non-motorized tread, the generator having a rotatable portion, wherein motion of the non-motorized tread rotates the rotatable portion of the generator, and wherein the rotatable portion of the generator has a resistance to rotation that applies a braking force to the non-motorized tread, and wherein the resistance to rotation is increased to increase the braking force to the non-motorized tread.

14. A method for controlling the speed of a non-motorized tread on an exercise treadmill, the treadmill having a frame, a non-motorized tread operatively mounted on the frame, an angle adjustment mechanism operatively engaged with the tread, a speed sensor, and a controller in communication with the angle adjustment mechanism and the speed sensor, the method comprising the steps of:

operating the tread at a first tread speed;

sensing a speed parameter of the tread with the speed sensor;

transmitting the speed parameter from the speed sensor to the controller;

comparing the tread speed parameter for the first tread speed to a first target speed parameter in the controller to determine whether the tread speed parameter for the first tread speed is within a predetermined target speed parameter range; and controlling the angle adjustment mechanism to adjust the incline angle of the tread until the tread speed parameter is within the target speed parameter range.

15. The method of claim 14, and further comprising the steps of:

entering into the controller a second target speed;

comparing the speed parameter to the second target speed parameter in the controller to determine whether the tread speed parameter is within a predetermined target speed parameter range; and controlling the angle adjustment mechanism to adjust the incline angle of the tread until the tread speed parameter is within the target speed parameter range.

16. The method of claim 14, wherein the step of controlling the angle adjustment mechanism to adjust the incline angle of the non-motorized tread is automatic.

17. The method of claim 14, wherein the step of controlling the angle adjustment mechanism comprises the step of:

increasing the tread angle relative to horizontal to increase the speed parameter.

18. The method of claim 14, wherein the step of controlling the angle adjustment mechanism comprises the step of:

decreasing the tread angle relative to horizontal to decrease the speed parameter.

19. The method of claim 14, and further comprising the steps of:

engaging the tread with an energy storage device; and storing energy generated by the non-motorized tread in the energy storage device.

20. The method of claim 14, and further comprising the steps of:

engaging the tread with an energy storage device, wherein the energy storage device is a flywheel; and storing energy generated by the non-motorized tread in the flywheel.

21. The method of claim 14, and further comprising the step of:

generating electricity from movement of the non-motorized tread.

22. The method of claim 14, and further comprising the steps of:

engaging the tread with an energy storage device;

storing energy generated by the non-motorized tread in the energy storing device; and powering the controller and the angle adjustment mechanism with energy stored in the energy storage device.

23. The method of claim 14, and further comprising the steps of:

decreasing the speed parameter with a braking mechanism when the speed parameter is greater than the target speed parameter range.

24. The method of claim 14, wherein the step of decreasing the tread speed comprises the step of:

decreasing the tread angle relative to horizontal to decrease the speed parameter; and applying a brake force to decrease speed parameter.

25. The method of claim 14, and further comprising the steps of:

entering into the controller a resistance level for the non-motorized tread; and controlling the resistance of non-motorized tread movement with a braking force.

* * * * *